US005334068A

United States Patent [19]

Davis

[11] Patent Number: 5,334,068

[45] Date of Patent: Aug. 2, 1994

[54] MODEL AIRCRAFT CORRUGATED PAPER BOARD AIRFOIL AND METHOD OF MAKING SAME

[76] Inventor: Ronald T. Davis, 6640 Sepulveda Blvd., #212, Van Nuys, Calif. 91411

[21] Appl. No.: 973,513

[22] Filed: Nov. 9, 1992

[51] Int. Cl.[5] ..... A63H 27/18

[52] U.S. Cl. ..... 446/34; 446/488; 244/123

[58] Field of Search ..... 446/34, 61, 67, 66, 446/488; 244/123

[56] References Cited

U.S. PATENT DOCUMENTS

| | | | |
|---|---|---|---|
| 2,154,487 | 4/1939 | Bonnell | 446/67 |
| 2,396,886 | 3/1946 | Rossiter | 446/34 |
| 3,224,138 | 12/1965 | Shapiro | 446/67 |
| 3,858,349 | 1/1975 | McClendon | 446/57 |

FOREIGN PATENT DOCUMENTS

| | | | |
|---|---|---|---|
| 600919 | 6/1978 | Switzerland | 446/67 |

*Primary Examiner*—Mickey Yu

*Attorney, Agent, or Firm*—John J. Posta, Jr.

[57] ABSTRACT

A remote control model aircraft airfoil or wing of novel design and a related method for the construction of the airfoil or wing are disclosed in which the airfoil or wing is made of a single sheet board in a manner ensuring that the airfoil or wing is both strong and durable. A plurality of now parallel lines are scored on the interior of the sheet of material with the material being folded on the scored lines to form the airfoil or wing. In the preferred embodiment, the resulting apparatus forms a flying wing which may be used as a glider. In an alternate embodiment, a straight wing with or without polyhedral surfaces may be crafted in much the same manner.

22 Claims, 5 Drawing Sheets

MODEL AIRCRAFT CORRUGATED PAPER BOARD AIRFOIL AND METHOD OF MAKING SAME

BACKGROUND OF THE INVENTION

Field of the Invention

The present invention relates generally to remote control model aircraft airfoil or wing building, and more particularly to a novel design and method for the inexpensive construction of an airfoil or wing or the like for incorporation into a model aircraft, with the airfoil or wing being made of a single sheet of corrugated paper board material in a manner ensuring that the airfoil or wing is both strong and durable.

Remote control model aircraft have become increasingly popular in the recent past, with the number of hobbyists increasing while the technology offers an ever-increasing diversity of different designs for model aircraft. While there is an incredibly wide variety of designs and components to choose from, ranging from simple molded foam models to complex balsa designs covered with synthetic film material, all of the designs may be categorized rather easily.

For example, all of the model aircraft fall into the categories of either fixed wing aircraft or rotating wing aircraft (helicopters). Similarly all of the model aircraft fall into the category of either gliders or powered aircraft. The present invention is concerned with fixed wing aircraft, and primarily with the design and construction of gliders, although the principles of the present invention are equally applicable to the design and construction of powered aircraft.

In order to overcome the force of gravity exerted by the Earth to enable a model aircraft to remain in the air, the aircraft must be acted upon by a lift force. This lift force is generated by air flowing over the surface of an airfoil, which draws on the principle of Bernoulli's law. The cross-section of the airfoil is designed so that the angle at which the airfoil is presented to the air causes the air to flow more swiftly over the upper surface of the airfoil than it does over the lower surface of the airfoil. As a result of this velocity differential, air pressure is lower above the airfoil than it is below the airfoil, which results in a lift force which urges the airfoil upwardly.

Fixed wing model aircraft utilize one or more airfoils to provide the lift force which enables the aircraft to fly. The primary airfoil which produces the most lift in a model aircraft, like a real aircraft, is the wing of the aircraft. Model aircraft wings may be either straight or swept back, and may be either only a portion of the model aircraft or substantially the entire model aircraft (essentially a flying wing). The model aircraft remains in flight whenever the lift force equals or exceeds the total weight of the model aircraft.

As might be expected, there exists a considerable variety in wing designs for fixed wing model aircraft. However, only a few construction methods are widely used for the construction of model aircraft wings. The more inexpensive method is molded foam construction, which results in a light weight wing of clean, smooth construction. While such foam wings are moderately priced, they are unfortunately not highly durable. In addition, some foam materials tend to melt in the presence of fuel or like liquids.

The most popular construction technique is the balsa frame which is built up and covered with a thin synthetic film. The balsa frame consists of spars extending the width of the wing, with ribs being used to hold the spars in place. The frame is quite complex of construction, and is thus labor intensive. The completed wing frame is covered with the thin synthetic material, which is adhesively secured and/or heat shrunk onto the wing.

It will at once be appreciated by those skilled in the art that such wings are the most desirable, since they are fairly strong and light weight. In addition, a wide variety of different wing constructions may be made by utilizing this process. Prebuilt wings used on almost-ready-to-fly (ARF) model aircraft are some of the nicest available, but they tend to be rather expensive to purchase. The wings may be built by the hobbyist, but they are extremely labor intensive and can require days or even weeks of work to build a single wing.

It is accordingly the primary objective of the present invention that it provide an improved model aircraft wing design and method for construction of the model aircraft wing which is not so highly labor intensive as the balsa and thin film construction. It is a further objective of the present invention that it utilize materials which are both easy to work with and readily available, thereby opening the hobby of remote control model aircraft to the widest segment of the population possible. In addition, the method of construction utilized by the model aircraft wing of the present invention should be relatively simple so as not to preclude inexperienced hobbyists from practicing the present invention.

It is a further objective of the present invention that it enable the construction of a widely diverse number of different wing and aircraft designs. It is a related objective of the present invention that it enable the construction of sophisticated wing designs, including multi-angle designs such as straight wings with polyhedral surfaces. The improved wing design of the present invention should additionally be adaptable to allow for mass production of prefabricated, unassembled wing and model aircraft components.

The apparatus of the present invention must also be of construction which results in assembled wings and model aircraft which are both durable and long lasting, and which allow considerable abuse while requiring little or no rebuilding or rework to be provided by the user. In order to enhance the market appeal of the apparatus and method of the present invention, they should also advantageously utilize the most inexpensive materials available to thereby afford it the broadest possible market. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention. With this invention, the primary airfoil of a model aircraft is made of a single sheet of corrugated paper board material, commonly referred to as cardboard. Construction of the airfoil consists of cutting the sheet of corrugated paper board in a desired configuration, scoring the sheet of corrugated paper board to create a number of interior fold lines, folding the sheet of corrugated paper board along the fold lines, and securing the edges of the sheet of corrugated paper board together in a unitary airfoil.

In the preferred embodiment, the airfoil constructed is used essentially as a flying wing, with the wing and body of the model aircraft constructed in a unitary manner. A double sheet of corrugated paper board is used in the preferred embodiment. Single layer corrugated paper board may be used for light lift areas. The basic outline border lines of the model aircraft wing are first marked on the corrugated paper board.

Next, the fold lines are laid out and marked on the surface of the corrugated paper board which will form the interior of the wing. These fold lines typically all have a common point, which may be located on the wing or off of the ends of the wing. It should be noted that the corrugations of the corrugated paper board will run between what will be the right and left sides of the wing. This results in the maximum strength of the wing.

At this point, the excess material may be removed by cutting along the border lines. The fold lines are then scored with a sharp instrument, typically cutting through the top layer of the corrugated paper board, and bending the center layer if there is one. The material immediately on each side of the fold lines is also slightly crushed inward.

The corrugated paper material may then be folded to form the wing. The edges of the wing are fastened together by thin adhesive tape in the preferred embodiment. Prior to using the adhesive tape to seal the wing into a rigid unit, remote control components may be located within the wing, where they are typically fastened using two-sided tape. Such remote control components in a glider typically include batteries, a receiver, and servos, together with servo control linkage.

Stability and control surfaces such as stabilizers and a rudder may be installed onto the assembled wing, typically using tape. The servo control linkage from the servos are then attached to the stability and control surfaces. Access holes may be located in the wing; these access holes may also be covered with tape when the model aircraft is to be flown. In another variation, a motor and propeller may also be located in the model aircraft.

Various different wing configurations and stability and control surface layouts may be utilized, the particulars of which result in a wide variety of model aircraft being capable of construction using the teachings of the present invention. Flying wings as well as conventional straight wings may be made using the principles of the present invention. By using additional bending lines scored in corresponding locations on both sides of the corrugated paper board, a straight wing with polyhedral surfaces may be constructed.

It may therefore be seen that the present invention teaches an improved model aircraft wing design, together with a method for construction of the model aircraft wing which is not nearly so highly labor intensive as balsa and thin film construction. The design of the model aircraft wing of the present invention utilizes materials which are both easy to work with and readily available, thereby opening the hobby of remote control model aircraft to the widest segment of the population possible. In addition, the method of construction utilized by the model aircraft wing of the present invention is relatively simple, so as not to preclude inexperienced hobbyists from practicing the present invention.

The method of construction of the present invention enables the construction of a widely diverse number of different wing and aircraft designs. In addition, the construction method of the present invention also enables the construction of sophisticated wing designs, even including multi-angle designs such as straight wings with polyhedral surfaces. The improved wing design of the present invention additionally is adaptable to allow for mass production of prefabricated, unassembled wing and model aircraft components.

The apparatus of the present invention is of a construction which results in assembled wings and model aircraft which are both durable and long lasting, and which allow considerable abuse while requiring little or no rebuilding or rework to be provided by the user. The design of the present invention together with its method of construction advantageously utilize the most inexpensive materials available to thereby afford it the broadest possible market. Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
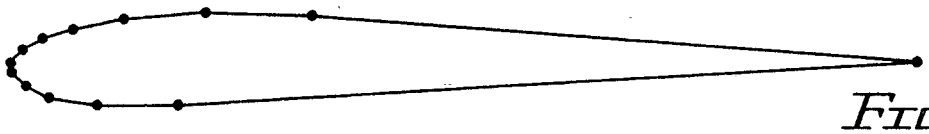
FIG. 1 is a schematic depiction of the cross-section of an airfoil such as a wing, showing a plurality of points with lines extending between the points forming the surface of the airfoil.

The preferred embodiment is based on the principle that the cross-section of an airfoil can be represented by a plurality of straight lines connected together between points approximating a curved surface. Referring to FIG. 1, such a series of straight lines between a plurality of points is illustrated. In the airfoils of the present invention, rather than the lines of FIG. 1 a series of flat surfaces separated by bends will be used. The flat surfaces are connected together, and are formed from a single segment of material.

While theoretically an infinite number of points and lines extending therebetween would make the approximation infinitely close to the actual bends, in practice this in unnecessary. By using bends at the points indicated in FIG. 1, a close approximation to the exact curve which fits the points may be made. Accordingly, the present invention will utilize a series of bends to form a series of flat segments approximating the curve.

Figure 2:
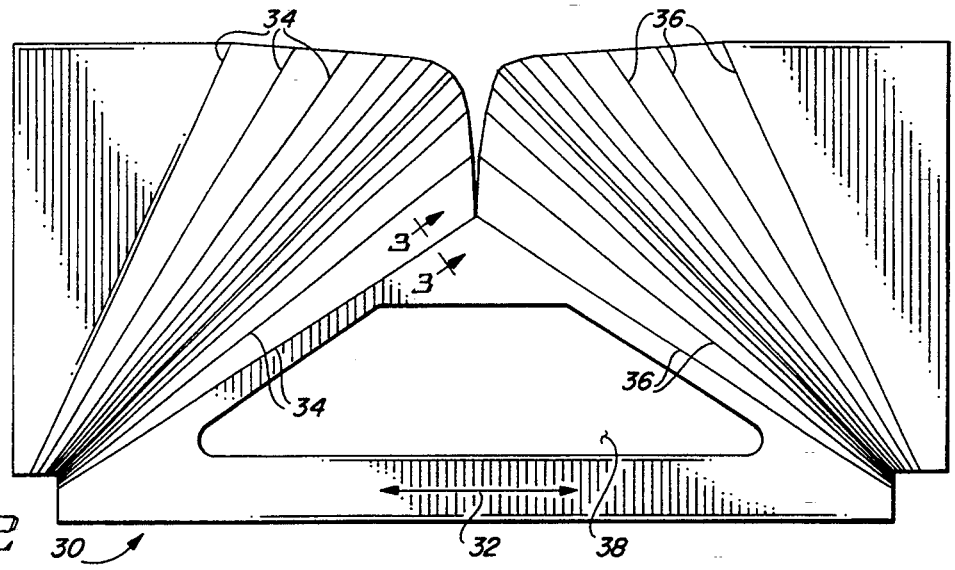
FIG. 2 is a top plan view of a sheet of corrugated paper board cut to form a flying wing of a first configuration, showing a plurality of fold lines scored in the top surface of the corrugated paper board.

Referring next to FIG. 2, a sheet of corrugated paper board 30 is illustrated which has been cut to form a flying wing of a first configuration. The sheet of corrugated paper board 30 has its corrugations running in the directions of the arrows indicated by the reference numeral 32, namely between what will be the left and the right of the flying wing to be formed of the sheet of corrugated paper board 30.

Note the plurality of fold lines 34 scored in the left side of the top surface of the sheet of corrugated paper board 30, as well as the plurality of fold lines 36 scored in the right side of the top surface of the sheet of corrugated paper board 30. If continued to the lower left of the sheet of corrugated paper board 30 as illustrated in FIG. 1, the fold lines 34 would intersect in a point. Similarly, if continued to the lower right of the sheet of corrugated paper board 30 as illustrated in FIG. 1, the fold lines 36 would also intersect in a point.

Note that the fold lines 34 and 36 are closer together at what will form the front of the flying wing, and further apart away from the front of the flying wing. This corresponds with the lines between the points in the approximation illustrated in FIG. 1. Note also that there is a gap between the left and right portions at the front of the sheet of corrugated paper board 30 as illustrated in FIG. 2. This is because the two sides will fold in somewhat toward the center along the fold lines 34 and 36.

Figure 3:
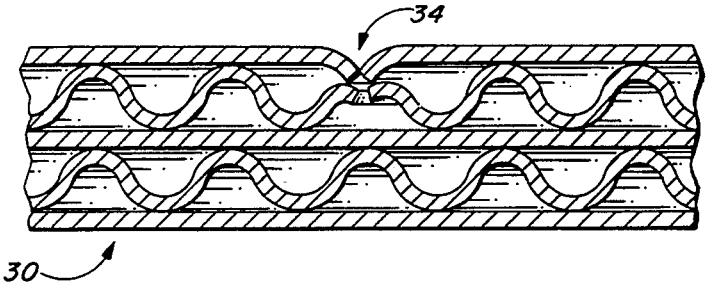
FIG. 3 is a cross-sectional view of a portion of the corrugated paper board illustrated in FIG. 2, taken across one of the fold lines and showing the cut top surface of the corrugated paper board and the crushed edges around the cut.

In the preferred embodiment, double layer corrugated paper board is used as the material of the sheet of corrugated paper board 30, as shown in FIG. 3. The preferred material is 270 lb. to 500 lb. bursting strength double layer corrugated paper board. At each fold line 34 or 36, the sheet of corrugated paper board 30 is scored to cut it part way through from the top side, as shown best in FIG. 3. The cut may be made with a dull cutting tool, to also crush it slightly inward to facilitate folding. The cutting operation may be made with a knife or the like in a manual operation, but in the preferred embodiment it will be cut by a die which will score all of the fold lines 34 and 36 in a single operation. If desired, a further reinforcing layer of corrugated paper board 38 may be glued onto the portion of the sheet of corrugated paper board 30 which will form the bottom of the flying wing.

Figure 4:
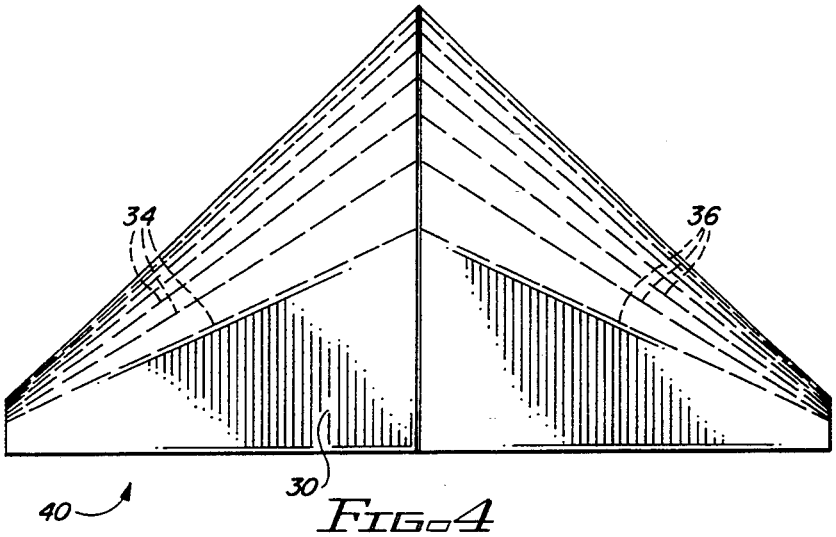
FIG. 4 is a top plan view of the corrugated paper board illustrated in FIG. 2 after it has been folded to form a wing, with the dotted lines showing the fold lines in the top of the wing.

Referring next to FIG. 4, the sheet of corrugated paper board 30 is formed into a the flying wing 40 by folding it along the fold lines 34 and 36 (FIG. 2). The cut portions of the fold lines 34 and 36 are now located inside the flying wing 40. Cross sections of the flying wing 40 will form an approximation of a curved wing surface as indicated in FIG. 1.

Figure 5:
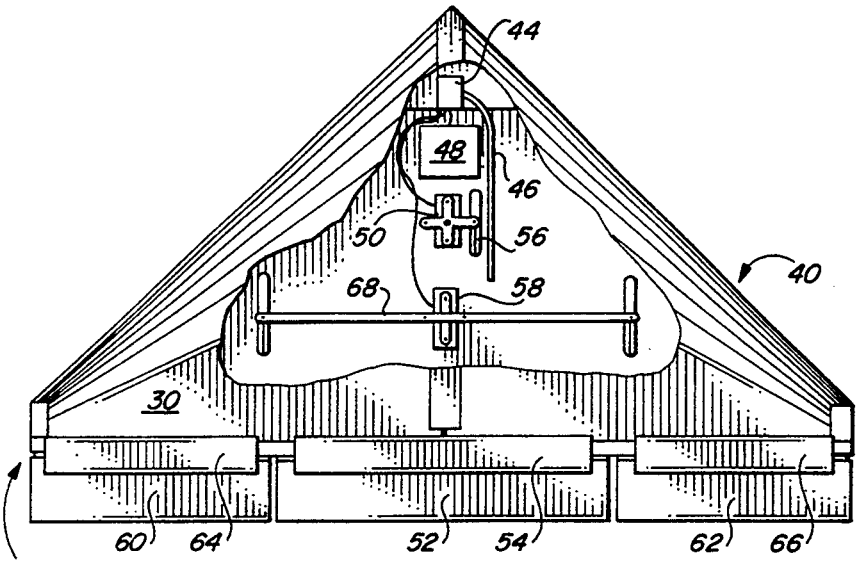
FIG. 5 is a cutaway view of a model glider constructed from the wing illustrated in FIG. 4, showing the stability and control surfaces located at the rear of the wing, as well as the remote control components located within the wing.

Referring now to FIG. 5, the construction of a glider 42 using the flying wing 40 of FIG. 4 is illustrated. Various radio control system components are mounted in the interior of the flying wing 40 on the reinforcing layer of corrugated paper board 38. Specifically, by way of example, a receiver 44 having a wire antenna 46 extending therefrom is mounted in the nose of the glider 42. The receiver 44 is powered by a battery pack 48, which is mounted in the glider 42 in back of the receiver 44.

A servo 50 is mounted behind the battery pack 48, and is used to control an elevator flap 52 centrally mounted behind the flying wing 40. The elevator flap 52 is movably attached to the trailing edge of the flying wing 40 by a strip of tape 54. The servo 50 is linked to the elevator flap 52 by a control linkage 56.

A servo 58 is mounted behind the servo 50, and is used to control a pair of ailerons 60 and 62 mounted behind the flying wing 40 on the sides of the elevator flap 52. The aileron 60 is movably attached to the left side of the trailing edge of the flying wing 40 by a strip of tape 64. The aileron 62 is movably attached to the right side of the trailing edge of the flying wing 40 by a strip of tape 66. The servo 58 is linked to the ailerons 60 and 62 by a control linkage 68.

The edges of the sheet of corrugated paper board 30 forming the flying wing 40 are also held together by tape in the preferred embodiment. Holes (not shown in FIG. 5) may be made in the sheet of corrugated paper board 30 forming the flying wing 40 to gain access to the radio control equipment after the glider 42 is fully assembled. Segments of tape (not shown in FIG. 5) will be used to cover up these holes. Additional holes (not shown) may be made in the sheet of corrugated paper board 30 forming the flying wing 40 to balance the glider 42; such holes may also be covered with segments of tape (not shown).

Figure 6:
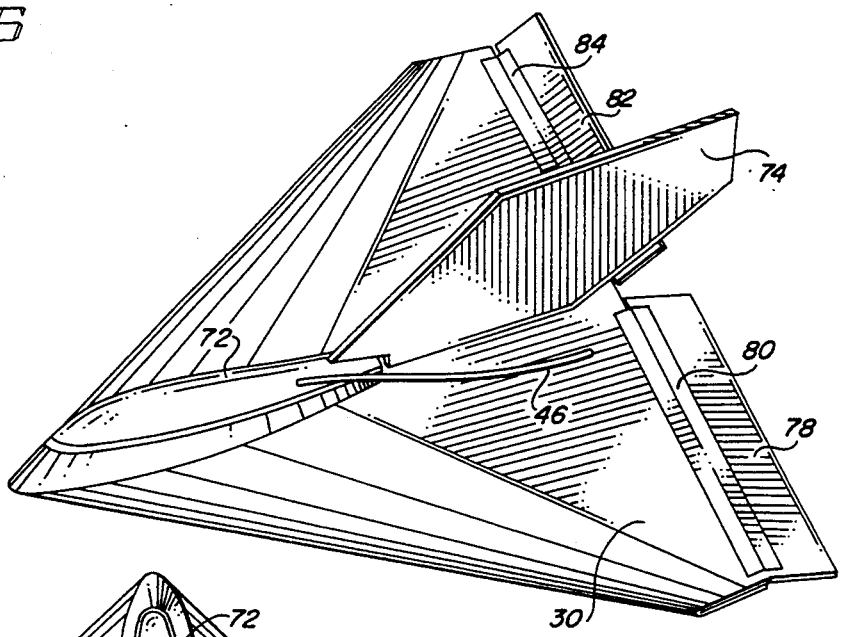
FIG. 6 is a perspective view of a model glider constructed from the wing illustrated in FIG. 4, showing the stability and control surfaces located at the rear of the wing, as well as a cockpit and a rudder and vertical stabilizer located on top of the wing.
Figure 7:
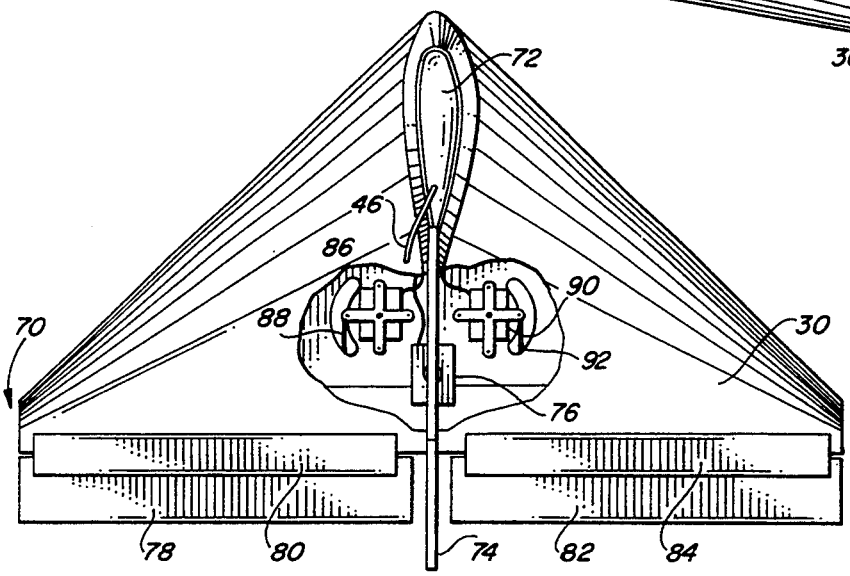
FIG. 7 is a cutaway view of the model glider illustrated in FIG. 7, showing the servos used to control the control surfaces located at the rear of the wing and the rudder located on top of the wing.

Referring next to FIGS. 6 and 7, a variation of the glider 42 illustrated in FIG. 5 is illustrated, with similar components receiving the same reference numerals as in FIG. 5. Specifically, a glider 70 made of the flying wing 40 is illustrated, which has a cockpit 72 located on the top side of the flying wing 40 at the front thereof. The cockpit 72 may also be made of corrugated paper board, which is taped onto the flying wing 40. The wire antenna 46 is shown trailing from the cockpit 72.

The glider 70 includes a vertical stabilizer and rudder 74, which is operated by a servo 76. It also includes two other control surfaces mounted at the rear of the flying wing 40, which control surfaces may either be operated together by a single servo as an elevator (this configuration is not shown), operated together by a single servo as ailerons (this configuration is also not shown), or as control flaps each operated by separate servos (the configuration illustrated).

A control flap 78 is movably attached to the left side of the trailing edge of the flying wing 40 by a strip of tape 80. A control flap 82 is movably attached to the right side of the trailing edge of the flying wing 40 by a strip of tape 84. A servo 86 is used to drive the control flap 78 via a control linkage 88. A servo 90 is used to drive the control flap 82 via a control linkage 92.

Figure 8:
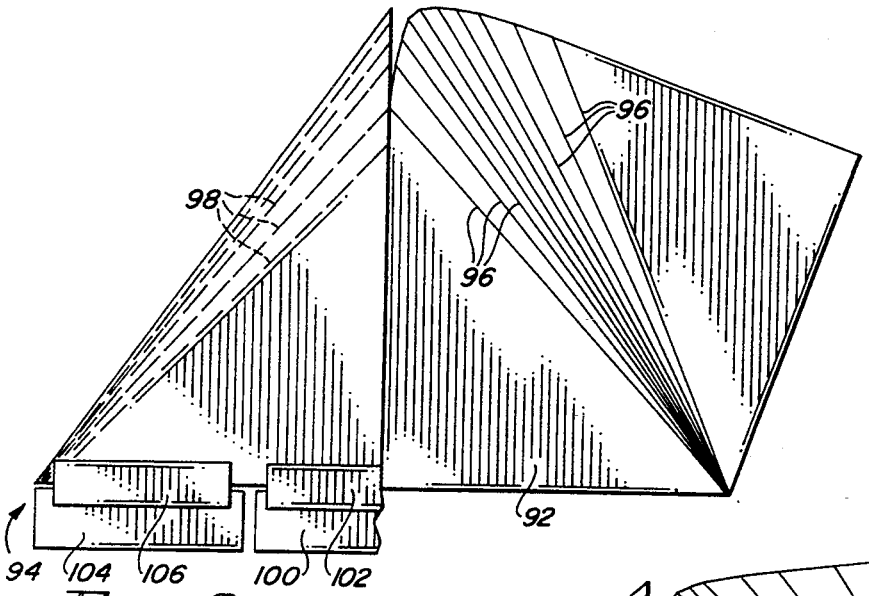
FIG. 8 is a top plan view of a sheet of corrugated paper board cut and scored to form a flying wing of a second configuration, with the left side folded to form a wing, with the dotted lines showing the fold lines in the top of the wing, and also showing stability and control surfaces located at the rear of the left side of the wing.
Figure 9:
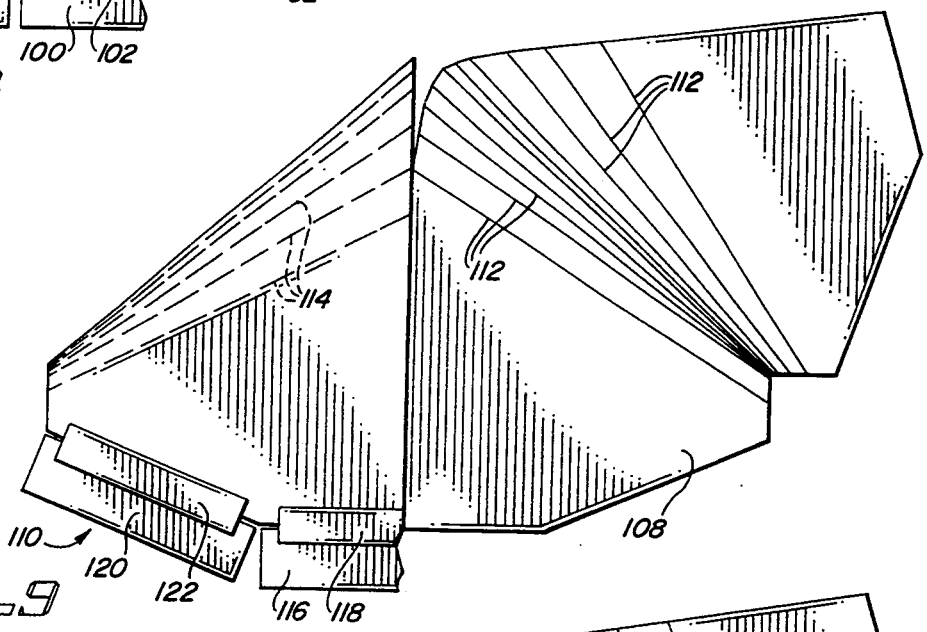
FIG. 9 is a a top plan view of a sheet of corrugated paper board cut and scored to form a flying wing of a third configuration, with the left side folded to form a wing, with the dotted lines showing the fold lines in the top of the wing, and also showing stability and control surfaces located at the rear of the left side of the wing.
Figure 10:
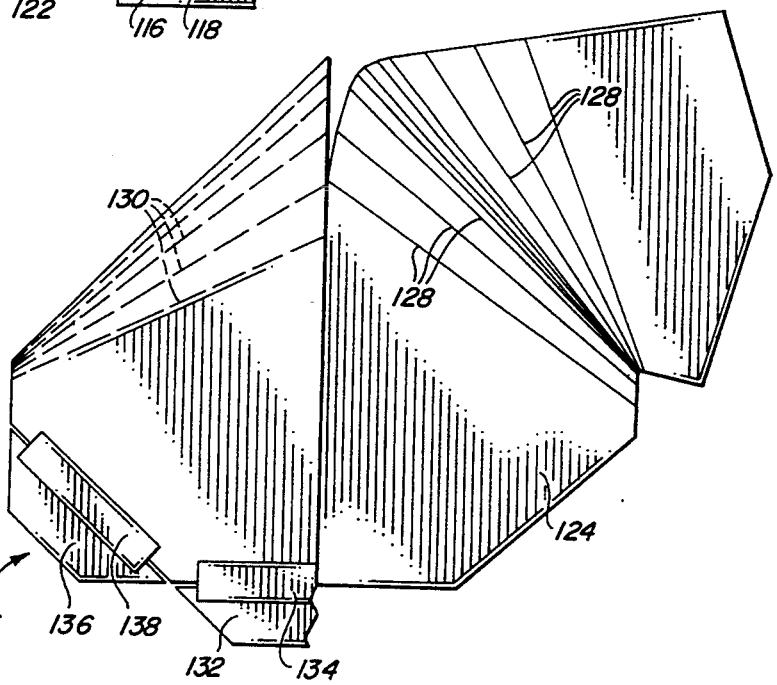
FIG. 10 is a a top plan view of a sheet of corrugated paper board cut and scored to form a flying wing of a fourth configuration, with the left side folded to form a wing, with the dotted lines showing the fold lines in the top of the wing, and also showing stability and control surfaces located at the rear of the left side of the wing.

A number of other flying wing configurations are also possible; three such configurations are shown in FIGS. 8 through 10. All three of these embodiments are shown with the right half flat and unfolded with the fold lines shown therein, and with the left side folded into a flying wing half. Referring first to FIG. 8, a sheet of corrugated paper board 92 is illustrated which has been cut to form a flying wing 94 of a second configuration. The sheet of corrugated paper board 92 has its corrugations running between what will be the left and the right of the flying wing 94 to be formed of the sheet of corrugated paper board 92.

A plurality of fold lines 96 are scored in the right side of the top surface of the sheet of corrugated paper board 92; some of a plurality of fold lines 98 scored in the left side of the top surface of the sheet of corrugated paper board 92 are visible as dotted lines in the top surface of the folded left half of the flying wing 94 shown in FIG. 8. The left half of an elevator flap 100 is illustrated centrally mounted behind the flying wing 94 by a strip of tape 102. An aileron 104 is movably attached to the left side of the trailing edge of the flying wing 94 by a strip of tape 106.

Referring next to FIG. 9, a sheet of corrugated paper board 108 is illustrated which has been cut to form a flying wing 110 of a third configuration. The sheet of corrugated paper board 108 has its corrugations running between what will be the left and the right of the flying wing 110 to be formed of the sheet of corrugated paper board 108.

A plurality of fold lines 112 are scored in the right side of the top surface of the sheet of corrugated paper board 108; some of a plurality of fold lines 114 scored in the left side of the top surface of the sheet of corrugated paper board 108 are visible as dotted lines in the top surface of the folded left half of the flying wing 110 shown in FIG. 9. The left half of an elevator flap 116 is illustrated centrally mounted behind the flying wing 110 by a strip of tape 118. An aileron 120 is movably attached to the left side of the trailing edge of the flying wing 110 by a strip of tape 122.

Referring now to FIG. 10, a sheet of corrugated paper board 124 is illustrated which has been cut to form a flying wing 126 of a fourth configuration. The sheet of corrugated paper board 124 has its corrugations running between what will be the left and the right of the flying wing 126 to be formed of the sheet of corrugated paper board 124.

A plurality of fold lines 128 are scored in the right side of the top surface of the sheet of corrugated paper board 124; some of a plurality of fold lines 130 scored in the left side of the top surface of the sheet of corrugated paper board 124 are visible as dotted lines in the top surface of the folded left half of the flying wing 126 shown in FIG. 10. The left half of an elevator flap 132 is illustrated centrally mounted behind the flying wing 126 by a strip of tape 134. An aileron 136 is movably attached to the left side of the trailing edge of the flying wing 126 by a strip of tape 138.

Figure 11:
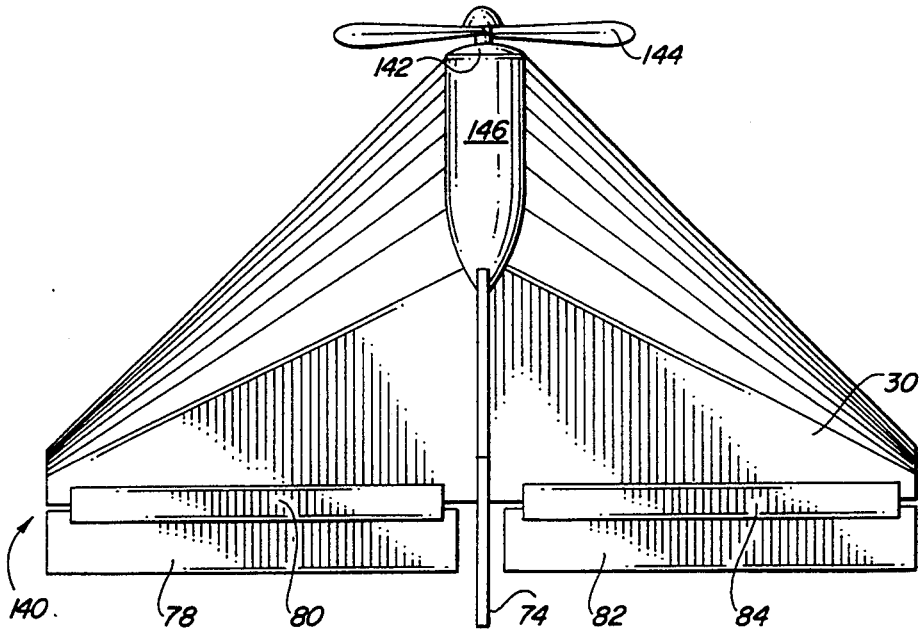
FIG. 11 is a cutaway view of a model airplane constructed from the wing illustrated in FIG. 4, showing the stability and control surfaces located at the rear of the wing, as well as a cockpit and a rudder and vertical stabilizer located on top of the wing, and also showing the motor and the propeller located at the front of the model airplane.

Referring next to FIG. 11, a model airplane 140 is illustrated which is similar to the glider 70 illustrated in FIGS. 6 and 7. Wherever similar components are used, the same reference numerals used in FIGS. 6 and 7 are used, the difference is that an electric motor 142 and a prop 144 are mounted at the front of the model airplane 140. A modified cockpit 146 is also located at the front of the model airplane 140.

Figure 12:
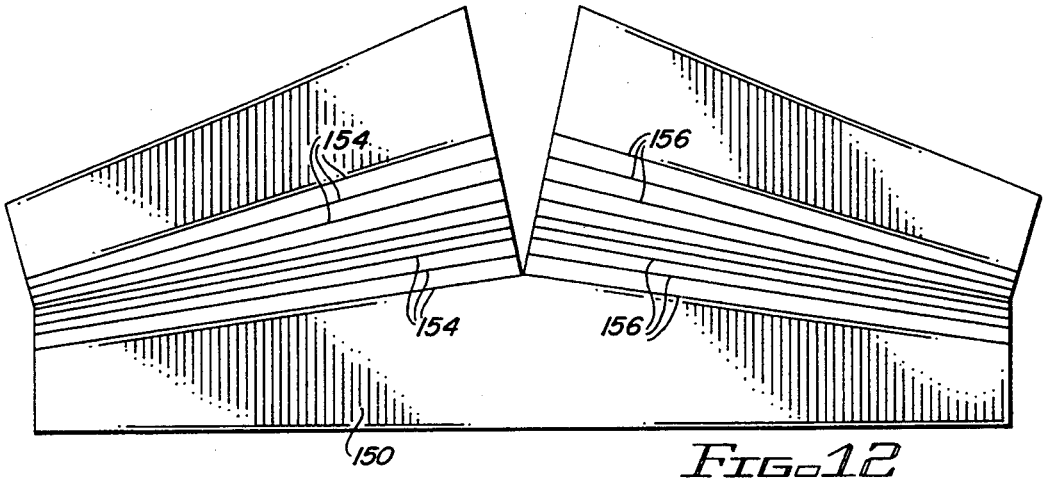
FIG. 12 is a top plan view of a sheet of corrugated paper board cut to form a straight wing, showing a plurality of fold lines scored in the top surface of the corrugated paper board.

Moving now to FIG. 12, a sheet of corrugated paper board 150 is illustrated which has been cut to form a straight wing 152. The sheet of corrugated paper board 150 has its corrugations running between what will be the left and the right of the straight wing 152 to be formed of the sheet of corrugated paper board 150. A plurality of fold lines 154 are scored in the left side of the top surface of the sheet of corrugated paper board 150. Similarly, a plurality of fold lines 156 are scored in the right side of the top surface of the sheet of corrugated paper board 150.

Figure 13:
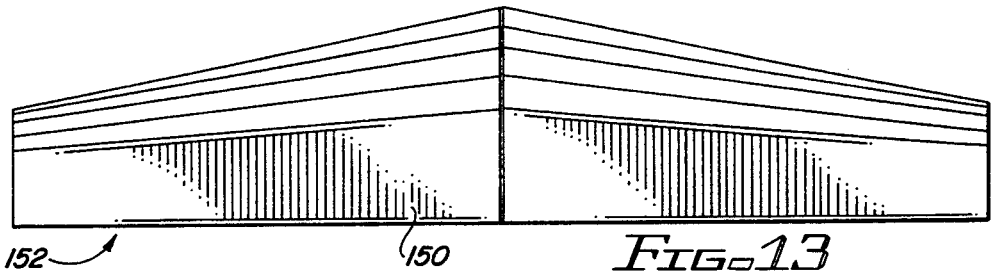
FIG. 13 is a top plan view of the corrugated paper board illustrated in FIG. 12 after it has been folded to form a straight wing.
Figure 14:
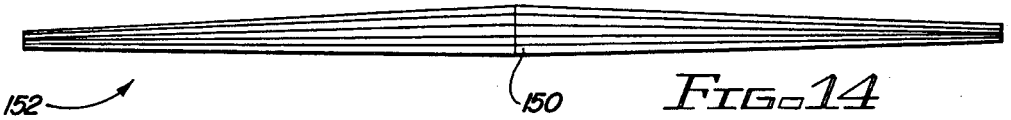
FIG. 14 is a front view of the straight wing illustrated in FIG. 13.

Referring next to FIGS. 13 and 14, the sheet of corrugated paper board 150 has been folded to form the straight wing 152. Note particularly in FIG. 14 that the straight wing 152 is straight; this will serve as a contrast to the straight wing with polyhedral surfaces to follow.

Figure 15:
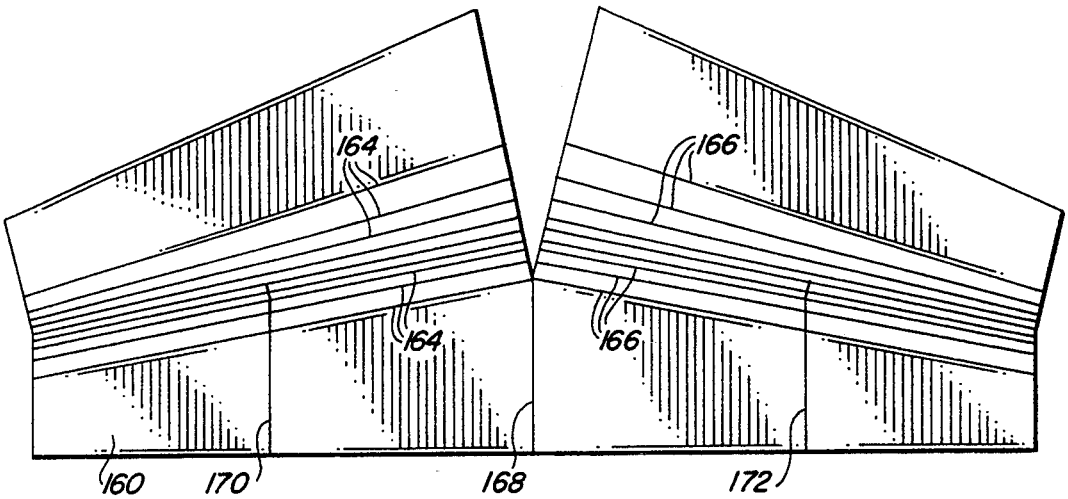
FIG. 15 is a top plan view of a sheet of corrugated paper board cut to form a straight wing with polyhedral surfaces, showing a plurality of fold lines scored in the top surface of the corrugated paper board, and also showing three bending lines which will be used to form bends in the straight wing with polyhedral surfaces.
Figure 16:
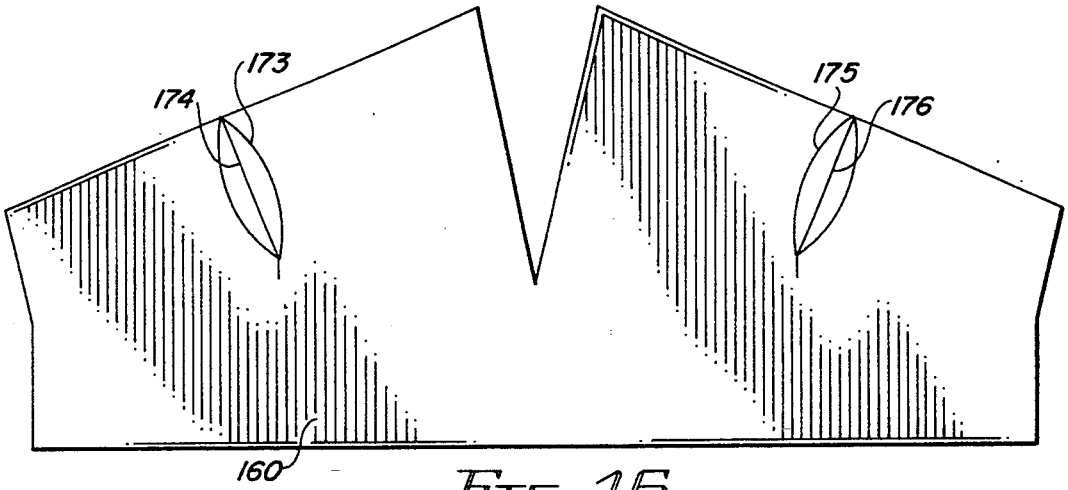
FIG. 16 is a bottom plan view of the sheet of corrugated paper board illustrated in FIG. 15, showing two additional bending lines which will be used to form bends in the straight wing with polyhedral surfaces.

Referring now to FIGS. 15 and 16, a sheet of corrugated paper board 160 is illustrated which has been cut to form a straight wing with polyhedral surfaces 162. The sheet of corrugated paper board 160 also has its corrugations running between what will be the left and the right of the straight wing with polyhedral surfaces 162 to be formed of the sheet of corrugated paper board 160. A plurality of fold lines 164 are scored in the left side of the top surface of the sheet of corrugated paper board 160. Similarly, a plurality of fold lines 166 are scored in the right side of the top surface of the sheet of corrugated paper board 160.

Located in the top side of the sheet of corrugated paper board 160 as shown in FIG. 15 are three additional bending lines 168, 170, and 172. These three additional bending lines 168, 170, and 172 are each scored in the top surface of the sheet of corrugated paper board 160. All three of these additional bending lines 168, 170, and 172 are located in what will be the interior of the bottom half of the straight wing with polyhedral surfaces 162.

The additional bending line 168 is located at the centerline of the sheet of corrugated paper board 160. The additional bending line 170 is located approximately midway between the centerline of the sheet of corrugated paper board 160 and the left side of the sheet of corrugated paper board 160. The additional bending line 172 is located approximately midway between the centerline of the sheet of corrugated paper board 160 and the right side of the sheet of corrugated paper board 160.

Located in the bottom side of the sheet of corrugated paper board 160 as shown in FIG. 16 are two additional bending lines 174 and 176. These two additional bending lines 174 and 176 are each scored in the bottom surface of the sheet of corrugated paper board 160. Both of these additional bending lines 174 and 176 are located in what will be the exterior of the top half of the straight wing with polyhedral surfaces 162. In order to allow for the bend to take place, part of the top surface has been removed at 173 & 175.

The additional bending line 174 is located approximately midway between the centerline of the sheet of corrugated paper board 160 and the left side of the sheet of corrugated paper board 160. The additional bending line 176 is located approximately midway between the centerline of the sheet of corrugated paper board 160 and the right side of the sheet of corrugated paper board 160.

Depending on the amount of polyhedral bend, the front edge of the sheet of corrugated paper board 160 may also be slit between the additional bending line 170 and the left side of the fold lines 130 (not shown), and between the additional bending line 172 and the right side of the fold lines 130. If only a small amount of polyhedral angle is to be added, the slit is not necessary.

Figure 17:
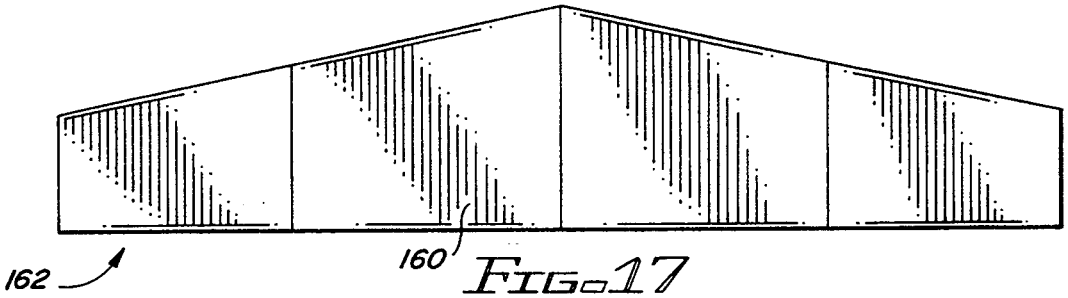
FIG. 17 is a top plan view of the corrugated paper board illustrated in FIGS. 16 and 17 after it has been folded to form a straight wing with polyhedral surfaces.
Figure 18:
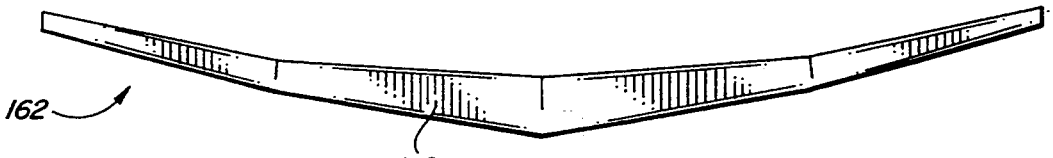
FIG. 18 is a front view of the straight wing with polyhedral surfaces illustrated in FIG. 17.

Referring next to FIGS. 17 and 18, the sheet of corrugated paper board 160 has been folded to form the straight wing with polyhedral surfaces 162. Note particularly in FIG. 18 that the straight wing with polyhedral surfaces 162 exhibits polyhedral angles; this is in contrast to the straight wing 152 in FIG. 14.

It may therefore be appreciated from the above detailed description of the preferred embodiment of the present invention that it teaches an improved model aircraft wing design, together with a method for construction of the model aircraft wing which is not nearly so highly labor intensive as balsa and thin film construction. The design of the model aircraft wing of the present invention utilizes materials which are both easy to work with and readily available, thereby opening the hobby of remote control model aircraft to the widest segment of the population possible. In addition, the method of construction utilized by the model aircraft wing of the present invention is relatively simple, so as not to preclude inexperienced hobbyists from practicing the present invention.

The method of construction of the present invention enables the construction of a widely diverse number of different wing and aircraft designs. In addition, the construction method of the present invention also enables the construction of sophisticated wing designs, even including multi-angle designs such as straight wings with polyhedral surfaces. The improved wing design of the present invention additionally is adaptable to allow for mass production of prefabricated, unassembled wing and model aircraft components.

The apparatus of the present invention is of a construction which results in assembled wings and model aircraft which are both durable and long lasting, and which allow considerable abuse while requiring little or no rebuilding or rework to be provided by the user. The design of the present invention together with its method of construction advantageously utilize the most inexpensive materials available to thereby afford it the broadest possible market. Finally, all of the aforesaid advantages and objectives of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. For example, other shapes and materials might be employed, including plastic coated cardboard, etc. All such changes, modifications, and alterations should therefore be seen as being within the scope of the present invention.

What is claimed is:

1. A method of making a model aircraft comprising:

trimming a single flat segment of material to form a main segment of a first side of an airfoil and left and right segments of a second side of said airfoil, said main segment and said left and right segments of said airfoil each having edges which will collectively form a front edge of said airfoil, said front edge of said left segment of said airfoil being adjacent a left half of said front edge of said airfoil, said front edge of said right segment of said airfoil being adjacent a right half of said front edge of said airfoil;

scoring a first plurality of non-parallel lines in one side of said main segment of said airfoil and said left segment of said airfoil;

scoring a second plurality of non-parallel lines in one side of said main segment of said airfoil and said right segment of said airfoil;

bending said main segment and said left and right segments of said airfoil along said first and second pluralities of lines to form said airfoil and to bring edges of said main segment and said left and fright segments which are unsecured together;

and fastening said unsecured edges of said main segment and said left and right segments of said airfoil together to render said airfoil inflexible.

2. A method as defined in claim 1, including:

mounting a plurality of movable stability and control surfaces on said airfoil;

installing remote control apparatus within said airfoil to control said stability and control surfaces; wherein said installing step comprises:

installing a receiver, an antenna for said receiver, a plurality of servos, and means for powering said receiver and servos within said airfoil to control said stability and control surfaces.

3. A method as defined in claim 2, wherein said mounting step comprises:

mounting a vertical stabilizer and rudder on said airfoil; and mounting two control flaps on the trailing edge of said airfoil.

4. A method as defined in claim 2, wherein said mounting step comprises:

mounting an elevator flap at the center of the trailing edge of said airfoil; and mounting an aileron on each side of said elevator flap on the trailing edge of said airfoil.

5. A method as defined in claim 1, wherein in said trimming step the orientation of corrugation in said main segment is caused to be between the ends of said airfoil at the far left and far right ends thereof.

6. A method of making an airfoil for use with a model aircraft, comprising:

trimming a single flat segment of material to form a main segment of a first side of an airfoil and left and right segments of a second side of said airfoil, said main segment and said left and right segments of said airfoil each having edges which will collectively form a front edge of said airfoil, said front edge of said left segment of said airfoil being adjacent a left half of said front edge of said airfoil, said front edge of said right segment of said airfoil being adjacent a right half of said front edge of said airfoil;

scoring a first plurality of non-parallel lines in one side of said main segment of said airfoil and said left segment of said airfoil;

scoring a second plurality of non-parallel lines in one side of said main segment of said airfoil and said right segment of said airfoil;

bending said main segment and said left and right segments of said airfoil along said first and second pluralities of lines to form said airfoil and to bring edges of said main segment and said left and right segments which are unsecured together; and fastening said unsecured edges of said main segment and said left and right segments of said airfoil together to render said airfoil inflexible.

7. A method as defined in claim 6, wherein said airfoil comprises a straight wing, additionally comprising:

scoring a third plurality of lines in said one side of said main segment;

scoring a fourth plurality of lines in the other side of said left and right segments of said airfoil; and bending said airfoil along said third and fourth plurality of lines to form a polyhedral surface configuration in said airfoil.

8. A method as defined in claim 6, wherein said fastening step comprises:

applying adhesive tape to fasten said edges of said main segment and said left and right segments of said airfoil together.

9. A method as defined in claim 6, wherein said material is corrugated paper board and wherein in said trimming step the orientation of corrugation in said main segment is caused to be between the ends of said airfoil at the far left and far right ends thereof.

10. A method as defined in claim 9, wherein said corrugated paper board comprises double layer corrugated paper board, and wherein said scoring steps each comprise:

cutting through only a single layer of said double layer corrugated paper board.

11. A method as defined in claim 9, wherein said corrugated paper board comprises single layer corrugated paper board, and wherein said scoring steps each comprise:

cutting part way through said single layer corrugated paper board.

12. A model aircraft, comprising:

a single flat segment of material trimmed to form a main segment of a first side of an airfoil and left and right segments of a second side of said airfoil, said main segment and said left and right segments of said airfoil each having edges which will collectively form a front edge of said airfoil, said front edge of said left segment of said airfoil being adjacent a left half of said front edge of said airfoil, said front edge of said right segment of said airfoil being adjacent a right half of said front edge of said airfoil;

a first plurality of non-parallel lines scored in one side of said main segment of said airfoil and said left segment of said airfoil;

a second plurality of non-parallel lines scored in one side of said main segment of said airfoil and said right segment of said airfoil, said main segment and said left and right segments of said airfoil being bent along said first and second pluralities of lines to form said airfoil and to bring edges of said main segment and said left and right segments of said airfoil which are unsecured together;

and means for fastening said unsecured edges of said main segment and said left and right segments of said airfoil together to render said airfoil inflexible.

13. A model aircraft as defined in claim 12, including:

remote control apparatus installed within said airfoil, comprising:

a receiver;

an antenna for said receiver, a plurality of servos; and a means for powering said receiver.

14. A model aircraft as defined in claim 12, including a plurality of stability and control surfaces installed within said airfoil comprising:

a vertical stabilizer and rudder mounted on said airfoil; and two control flaps mounted on the trailing edge of said airfoil.

15. A model aircraft as defined in claim 12, including a plurality of stability and control surfaces installed within said airfoil comprising:

an elevator flap mounted at the center of the trailing edge of said airfoil; and an aileron mounted on each side of said elevator flap on the trailing edge of said airfoil.

16. A model aircraft as defined in claim 12, wherein said material is corrugated paper board and wherein the orientation of corrugation in said main segment extends between the ends of said airfoil at the far left and far right ends thereof.

17. An airfoil for use with a model aircraft, comprising:

a single flat segment of material trimmed to form a main segment of a first side of an airfoil and left and right segments of a second side of said airfoil, said main segment and said left and right segments of said airfoil each having edges which will collectively form a front edge of said airfoil, said front edge of said left segment of said airfoil being adjacent a left half of said front edge of said airfoil, said front edge of said right segment of said airfoil being adjacent a right half of said front edge of said airfoil;

a first plurality of non-parallel lines scored in one side of said main segment of said airfoil and said left segment of said airfoil;

a second plurality of non-parallel lines scored in one side of said main segment of said airfoil and said right segment of said airfoil, said main segment and said left and right segments of said airfoil being bent along said first and second pluralities of lines to form said airfoil and to bring edges of said main segment and said left and right segments of said airfoil which are unsecured together; and means for fastening said unsecured edges of said main segment and said left and right segments of said airfoil together to render said airfoil inflexible.

18. An airfoil as defined in claim 17, wherein said airfoil comprises:

a third plurality of lines scored in said one side of said main segment; and a fourth plurality of lines scored in the other side of said left and right segments of said airfoil, said airfoil being bent along said third and fourth plurality of lines to form a polyhedral surface configuration in said airfoil.

19. An airfoil as defined in claim 17, wherein said airfoil comprises:

a flying wing.

20. An airfoil as defined in claim 17, wherein said material is corrugated paper board and wherein the orientation of corrugation in said main segment extends between the ends of said airfoil at the far left and far right ends thereof.

21. An airfoil as defined in claim 20, wherein said corrugated paper board comprises:

a double layer corrugated paper board.

22. An airfoil as defined in claim 20, wherein said corrugated paper board comprises:

a single layer corrugated paper board.

* * * * *